United States Patent [19]

Marteau et al.

[11] 4,454,928

[45] Jun. 19, 1984

[54] MOVABLE SCAFFOLD FOR BUILDINGS

[76] Inventors: Raymond Marteau, 29, Route de Vineuil, 77410 Saint-Mesmes; Marcel R. Plaignaud, 29, Avenue de la Republique, Roissy-en-Brie-77680, both of France

[21] Appl. No.: 236,978

[22] Filed: Feb. 23, 1981

[30] Foreign Application Priority Data

Jun. 30, 1980 [FR] France ..... 80 14500

[51] Int. Cl.[3] ..... E04G 3/10

[52] U.S. Cl. ..... 182/36; 182/142; 248/237; 248/241

[58] Field of Search ..... 182/36, 37, 12, 13, 182/14, 15, 17, 142, 143, 144, 45; 248/241, 242, 236; 105/153; 104/242, 243, 244, 245, 246, 247, 248, 89, 93, 106, 107, 108, 109, 111; 49/322

[56] References Cited

U.S. PATENT DOCUMENTS

| | | | |
|---|---|---|---|
| 402,490 | 4/1889 | Taylor | 104/242 |
| 509,650 | 11/1893 | Brodie | 104/108 |
| 955,371 | 4/1910 | Wagner | 104/108 |
| 1,642,333 | 9/1927 | Damore | 182/37 |
| 3,518,947 | 7/1970 | Borst | 105/153 |
| 4,318,346 | 3/1982 | Sessum | 105/153 |

FOREIGN PATENT DOCUMENTS

| | | | |
|---|---|---|---|
| 2045659 | 3/1972 | Fed. Rep. of Germany | 105/153 |
| 9486 | 11/1900 | Norway | 182/13 |
| 1019275 | 2/1966 | United Kingdom | 182/36 |

*Primary Examiner*—Reinaldo P. Machado
*Assistant Examiner*—Alvin Chin-Shue
*Attorney, Agent, or Firm*—Darby & Darby

[57] ABSTRACT

Movable scaffold having a car which is suspended from two carriages (15, 16) joined by a cross bar (18), said carriages rolling inside a rail (10) suspended from support members mounted on the roof. The cross bar carries a safety bracket (21a) of a T-shaped configuration. Lateral movements are effected by operating, from the scaffold car, an endless rope (33) cooperating with a grooved pulley (32), integral with a friction roll, which is applied against the bottom surface of rail (10).

10 Claims, 7 Drawing Figures

101
102
103
104
105
106
107
108
109
110
111
112
113
114
115
116
117
118
119
120
121
122
123
124
125
126
127

MOVABLE SCAFFOLD FOR BUILDINGS

The present invention relates to a movable scaffold for buildings.

A movable scaffold generally consists of a scaffold car which is raised or lowered, as needed, along an exterior wall by ropes and tackle usually attached to hooks fixed to the roof.

Since work is done on a vertical area it is necessary to shift the location of the hooks to enable work to be done in adjoining areas. As a result, considerable time is lost in shifting and rearranging said hooks together with their supports.

To overcome this problem, the scaffold car was suspended from carriages which were able to move along a rail mounted on top of the building. The rail, in that case, had to be supported by means firmly anchored on the roof of the building. Such rails are generally composed of several sections joined end to end so as to conform to the entire length of a wall.

In the devices known hitherto, the rail generally consists of a cylindrical tube along which the carriages are able to roll. The wheels, arranged on the respective sides of the carriages, turn in planes converging toward the bottom, while one of the carriages, called the driving carriage, has, additionally a driving wheel equipped with a rubber tire frictionally supported on the upper surface of the rail and integrally rotating with an outer pulley which is operated by means of a rope from the scaffold car.

An arrangement of this type has serious drawbacks. To begin with, the said convergence of the planes of the wheels causes a pinching action on the rails, thus increasing to a considerable degree the force necessary for the movement. The said convergence also causes the shafts of the wheels to be subjected to torsion. As a consequence, the total carrying load of the rail is reduced to a value less than the rated value of said rail. Furthermore, the path of the carriage wheels and of the driving wheel is exposed and thus may be blocked by accidentally falling obstacles, such as fragments of materials, or by objects placed there unintentionally, such as boards, rods, tools, etc.) thus impeding the translational movement of the carriages.

To avoid the drawbacks mentioned above, U.S. Pat. No. 2,178,956 provides for the use of a rail of U-shaped cross section with its opening directed downward and its arms bent inward so as to form the runway for the carriages.

To shift the scaffold car relative to the support rail, French Pat. No. 1,297,234 provides for a winch with endless cable and return pulleys at the ends of the rail, lateral movement being achieved by operating said winch. The said means are relatively complicated and require return pulleys to be mounted at the ends of the rail and a cable to run along the entire length of said rail.

Object of invention is to provide a movable scaffold which is particularly well suited for work in horizontal sections along outer walls of buildings, said scaffold having safety means so as to prevent accidents in the event of breakdown of support carriages, can be readily shifted, and has support means that are easy to adjust so as to prevent sag of the longitudinal rail.

The present invention thus concerns a movable scaffold for use on buildings, wherein the scaffold car is suspended in the usual manner from at least two carriages connected to each other by a removable cross bar of a length approximately equal to that of the said scaffold car, and is movable along a rail formed by several sections put together, and mounted so as to overhang the top of the building by way of a series of support means placed on the roof, said scaffold being characterized in that near each end of the cross bar connecting the two carriages a T-shaped safety bracket is disposed the transversal bar of which is inside the U shaped rail, perpendicularly to the longitudinal plane of symmetry of said rail, and is longer than the spacing of the inward bent ends of the arms of the rail.

Other features of the invention are as follows:

- the linear components mounted end to end to form the rail are assembled by fitting, in a downward motion, one female end onto one male end, said female end having a part designed so as to rest on the upper surface of the male end and be locked thereon;
- the rail is composed of any desired number of intermediate components each having one female end and one male end, one head component closed at one end and having a male end at the other, and one tail component closed at one end and having a female end at the other, each rail component being provided with a means for suspension from the support member, said means being disposed within a short distance from its male end and from its closed end in case of the end sections;
- the lateral translational movement is effected by pulling on either of the two cables fastened respectively to the ends of the rail and hanging vertically from the scaffold car after passing over a return pulley mounted on the corresponding carriage;
- the translational movement of the suspension unit consisting of the two carriages and their cross bar is effected by operating, from the scaffold car, an endless rope or chain cooperating with a grooved pulley carried by the cross bar and integrally rotating with a friction roll having a rubber tire or the like which applies itself against the lower surface of the rail;
- the friction roll consists of twin wheels which respectively apply themselves against the bent edge of each arm of the rail;
- the friction roll is carried by an arm articulated with one end on the cross bar and subjected, in the vicinity of its opposite end, to the action of a spring pushing it toward the rail;
- each support member has a plate which is placed against the top of a wall; two stationary arms fastened in a substantially vertical plane, integrally with the said plate, and converging so as to be able to carry an anchoring head; two movable arms able to pivot relative to the plate and converging so as to be able to carry a hooking means for supporting the scaffold car; and a rod for regulating the position of the movable arms relative to the stationary arms;
- the movable arms are integral with a shaft pivoting on said plate;
- the anchoring head consists of a plate with bent edges which are welded to the stationary arms, said head carrying an anchoring ring adapted so as to accomodate a cable;
- the anchoring head has a slot into which the end sleeve of said regulating rod is inserted;
- the regulating rod has a handle at its end, said handle turning into a tube fastened, in the vicinity of the hooking member, to a support shaft which is integral with the movable arms;

a safety chain is mounted between said support shaft and the anchoring ring;

the hooking member is formed by a rod bent at its ends and incurved at its center.

The invention will be explained more fully and further features thereof will become apparent on hand of the following description of a preferred embodiment, which description is given by way of example only and refers to the attached drawings wherein.

Figure 1:
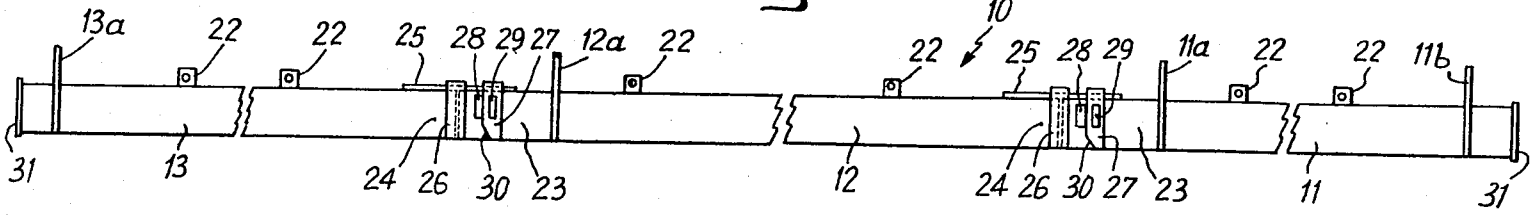
FIG. 1 shows, in assembly, the three types of components constituting a rail according to the invention.
Figures 5, 6:
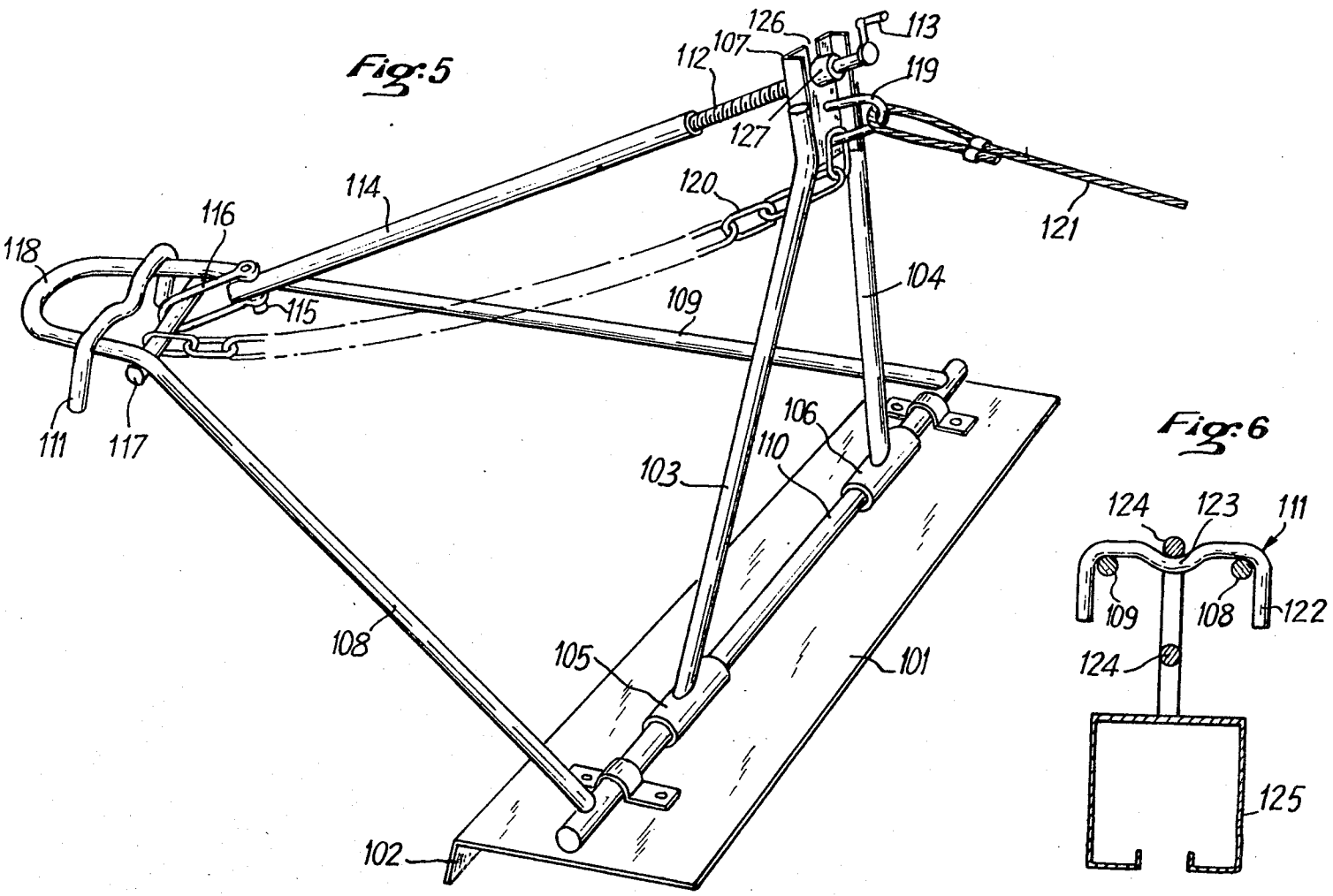
FIG. 5 shows a perspective view of an embodiment of a support member for a movable scaffold in accordance with the invention.
FIG. 6 shows a detailed view of a hooking member in accordance with one embodiment of the invention.

Referring now to the Figures, a rail 10 (FIG. 1) adapted for suspending therefrom and guiding in a lateral translational movement, along the wall of a building, a movable scaffold car (not shown), is formed by end to end assembly of linear components comprising a head component 11, any desired number of intermediary components 12 (only one shown in this example), and a tail component 13. Each component has at least one suspension means (11*a*, 11*b*, 12*a*, 13*a*), disposed in a manner to be explained further on, and adapted so as to be hooked to the overhanging ends of support members, as shown in FIG. 5, and mounted on the roof of said building.

Figure 2:
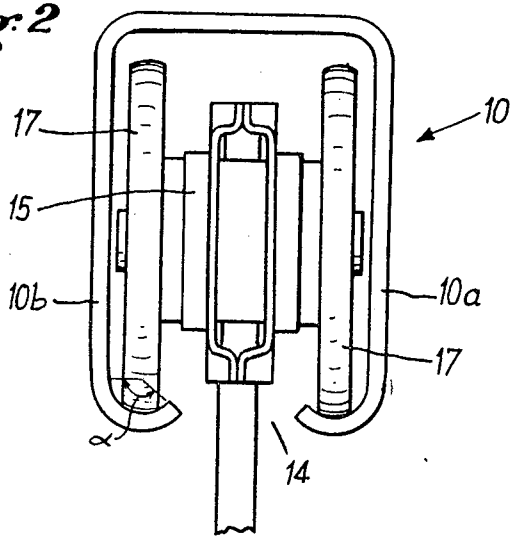
FIG. 2 shows, on a larger scale, an end view of a rail in which a carriage is engaged.

All the sections of the rail have a U-shaped configuration with its opening 14 pointing downwards (FIG. 2), the internal cross section being constant along the entire length of rail 10. The ends of arms (10*a*, 10*b*) are bent inwards, preferably along an arc having an angle $\alpha$ greater than 90° at its center. The internal face of the bent sections forms the track for the two carriages 15 and 16 each having at least two wheels 17 on each side thereof. The arc-shaped configuration of the bent sections encloses the bottom part of the treads of the said wheels, which are thus guided without risk of lateral friction of the carriages against the inner surface of arms 10*a* and 10*b* of the rail.

The two carriages 15 and 16 are joined by a cross bar 18 (FIGS. 3 and 4) which is detachable, and the length of which corresponds to that of the scaffold car to be suspended, each carriage carrying suspension means 19 and 20 for attaching tackles or similar means, fastened to the scaffold car in the conventional manner.

In the vicinity of each end, cross bar 18 carries, rigidly joined to it, a T-shaped bracket 21*a*, the transversal bar of which 21*b* is disposed inside rail 10, perpendicularly to the longitudinal plane of symmetry of said rail, and is longer than the distance between the lips of opening 14. The said bracket provides safety of the suspension in the event of breakdowns of the shafts of the wheels of a carriage.

Returning now to FIG. 1, it is seen that, in addition to suspension means (11*a*, 11*b* or 12*a* or 13*a*), each rail section carries two members 22 on its upper surface, such as rings or the like, so as to be able to handle said section with the aid of hoisting means. The rail components are assembled end to end by fitting one female end onto one male end in a downward motion. In this downward motion, the female end of the next section is lowered onto the male end of a section already in place and locked therewith. In the example shown, male end 23 is free from any supplementary elements, with the exception of an added stop 28 having a lug with an elongated hole. On the upper surface of the female end 24 of each section a bracket 25 is welded, whose overlapping part rests on the upper surface of the male end of the adjoining component. A stirrup 26 firmly welded thereon encloses the end portion of end 24, straddling the center section of bracket 25, and projects longitudinally so as to be able to straddle the end portion of end 23. At the same time, a stirrup 27, fastened in the vicinity of the protruding end of bracket 25, caps end 23, behind stop 28. The said stirrup 27 has a lug 29 with an elongated hole, and a pin (not shown) which makes the two sections of the rail integral with each other. To assure sturdiness of the unit, it is preferable to provide a forced fit of stirrup 27 against stop 28. To facilitate this operation, beveled faces 30 are provided in the lower portion for the flanges of the stirrup, on the side of the stop. Each intermediate component 12 must have one male end 23 and one female end 24, while head component 11 has one male end and is closed at its opposite end by a cap 31, and tail end 13 has one female end and one end closed by a cap 31.

Given that female end 24 rests on male end 23 of the adjacent section, it is obviously the latter which must be supported, and it is thus at the vicinity of said male end that suspension means (here an arch) 11*a*, 12*a*, 13*a* is disposed, the head component having a second suspension means 11*b* near its closed end. To laterally shift the suspension unit formed by the two carriages 15 and 16 and cross bar 18, each carriage can have an idle pulley (not shown) of a V-shaped configuration over which a cable passes which is fastened at one end to the corresponding end of rail 10 and whose other end hangs freely, vertically to the scaffold car.

Figure 3:
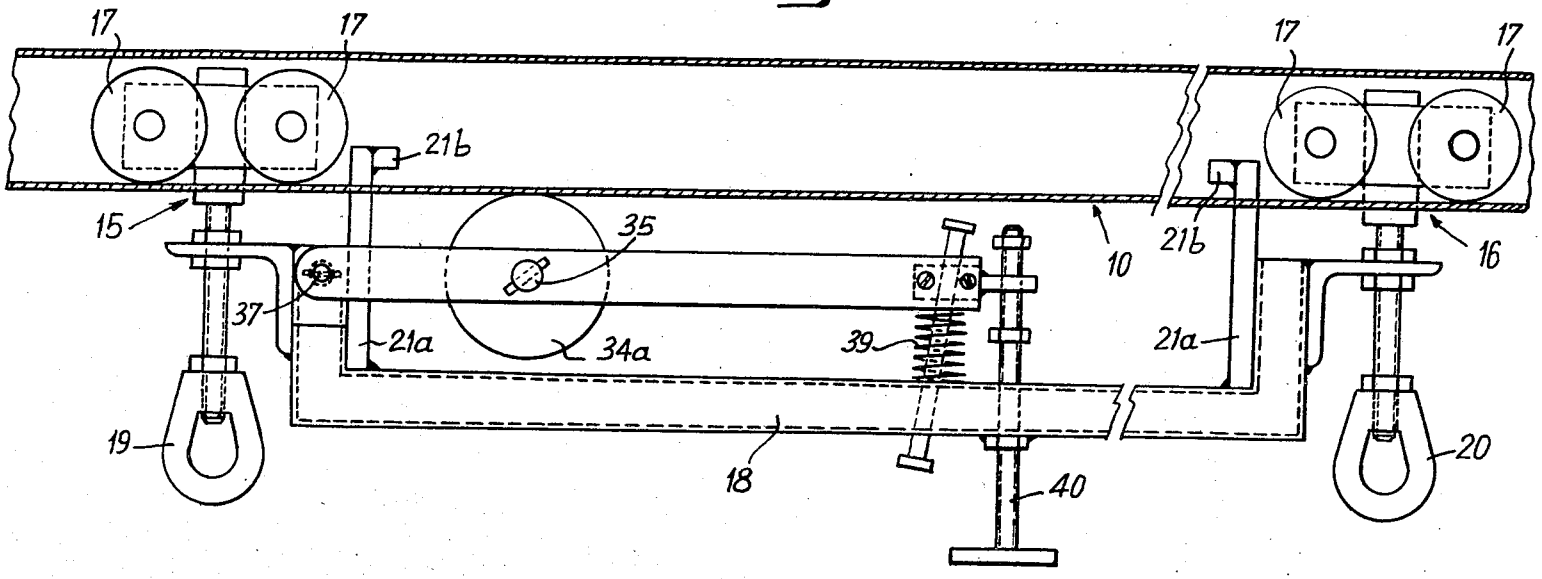
FIG. 3 shows the suspension unit formed by two carriages and a cross bar.
Figure 4:
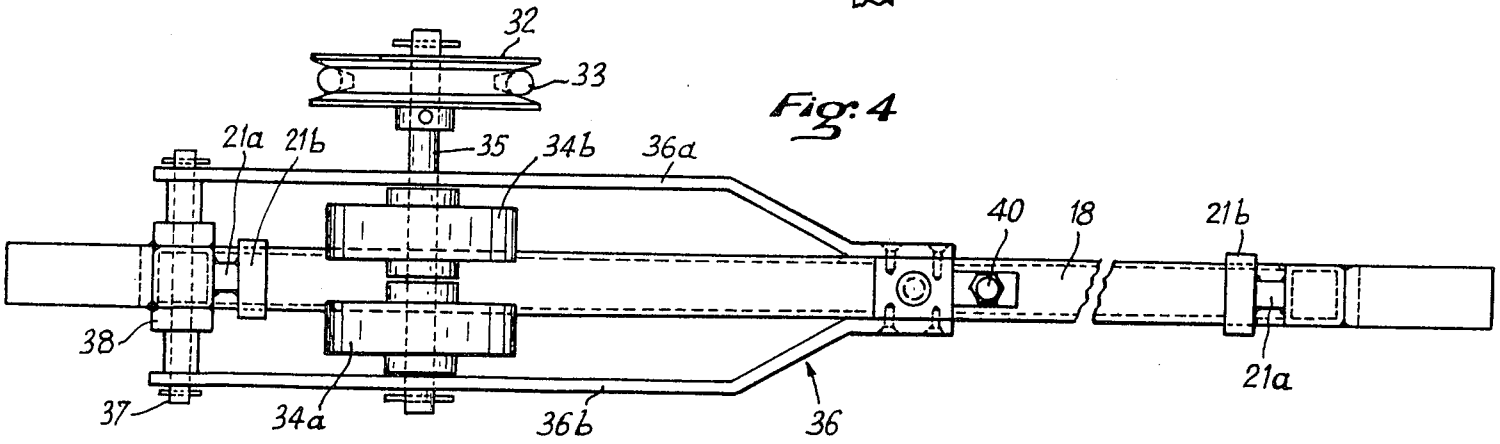
FIG. 4 shows a top view of the cross bar of the suspension unit with its articulated arm carrying driving friction rolls in lateral translational movement.

However, this simple arrangement can only be made for a narrow wall. For larger walls, it is necessary to provide a more elaborate driving system. Such a system is shown in FIGS. 3 and 4. It has a friction roll with rubber tread or the like which is applied against the lower face of rail 10 and integrally rotates with a pulley 32 carried by cross bar 18, said pulley having a trapezoidal groove for an endless rope 33, or notches for an endless chain, able to be operated from the scaffold car.

In the example shown, the friction roll consists of twin wheels 34*a* and 34*b* keyed on the same shaft 35 as pulley 32 and applying themselves respectively under the bent rims of arms 10*a* and 10*b* of the rail. To assure a substantially constant pressure of wheels 34*a* and 34*b* on the lower surface of rail 10 despite the wear of the treads, shaft 35 is journaled between cheeks 36*a* and 36*b* of a fork 36 articulated at the free ends of said cheeks about a shaft 37 passing through a socket 38 carried by cross bar 18, and being subject at its opposite end to the action of a spring 39 urging said end toward the lower face of rail 10. Wheels 34*a* and 34*b* are mounted on shaft 35 between cheeks 36*a* and 36*b* and drive pulley 32 is shifted outside fork 36, on said shaft 35. Finally, an adjusting screw 40 makes it possible to act on the cheeks of fork 36 so as to bring wheels 34*a*, 34*b* out of contact with rail 10, against the action of spring 39, so as to allow the mounting of the suspension unit by engaging it by one end of the rail prior to putting on cap 31, or by engaging it at the beginning of the mounting in the head component 11, prior to assembling the adjoining intermediary component 12.

In place of a screw 40, other equivalent means may be used, such means constituting, for example, a connecting rod and cam unit with two stable positions, or a bevel-square type bolt, or a quick release lever so as to keep spring 39 in a compressed state during mounting of the carriages inside the rail and quickly releasing it immediately thereafter.

Referring now to FIG. 5, it is seen that the support member of the scaffold car mainly consists of the following parts: a sole plate 101 with a front bend 102, to be placed on the top of a wall; two stationary arms 103 and 104 disposed in a substantially vertical plane, and being integral with sole plate 101 by way of sleeves 105, 106, said arms converging so as to support an anchoring head 107; two movable arms 108, 109, able to pivot relative to sole plate 101, e.g. by way of a shaft 110 passing through sleeves 105, 106, said movable arms converging so as to support a hooking member 111 which carries the scaffold car; and a rod 112 which regulates the position of the movable arms 108, 109 relative to stationary arms 103, 104.

The said rod 112 has a driving crank 113, is threaded, and turns in a tube 114 for example. Said tube 114 has a threaded shaft 115 of a shackle 116 going through it, said shackle going around a support shaft 117 which is welded to the bottom of the converging ends of arms 108 and 109. Opposite the said shaft 117, arms 108 and 109 are slightly bent and then join to form a loop 118 behind hooking member 111.

The anchoring head 107 mainly consists of a plate whose edges are raised and welded to arms 103 and 104. The said plate carries an anchoring ring 119 on which the end of a safety chain 120 is fastened, the second end of which being fastened to support shaft 117. A cable 121 is fastened to ring 119 to provide rear anchorage of the support member, said anchorage being effected by any known means.

Anchoring head 107 has a slot 126 into which the end sleeve 127 of threaded rod 112 is inserted.

FIG. 6 shows how hooking member 111 is placed on arms 108 and 109. The said hooking member 111 may consist of a round iron rod, for example, bent at both ends 122, and being incurved at the center to form a curvature 123 which accomodates the support ring 124 of a rail 125 running along a wall, from which rail the scaffold car is suspended. When ring 124 is housed in curvature 123, it urges it in a downward direction, and at the same time keeps the bent ends 122 of hooking member 111 down. The latter, thus, remains stable.

When the support member according to the invention is mounted on the top of a wall, soleplate 101 is on the wall and flange 102 rests against the front, stationary arms 103, 104 are in a substantially vertical plane, and the rear anchorage is obtained by cable 121 on ring 119. Threaded rod 112 is slid into a slot of anchoring head 107. After the rail 125 is hooked onto the support members in accordance with the invention, cranks 113 are operated so as to bring the rail to an even height over its entire length. In the event the mechanical connection between threaded rod 112, tube 114 and shackle or connecting link 116 should become defective, the safety chain 120 would prevent accidents.

When work is completed, the threaded rod 112 is taken out of its slot, movable arms 108, 109 are fully raised against stationary arms 103, 104, and rod 112 is brought down along one of arms 108, 109 so that the support member can be accomodated within a relatively small space, be readily transportable, and be easily used for further work.

Figure 7:
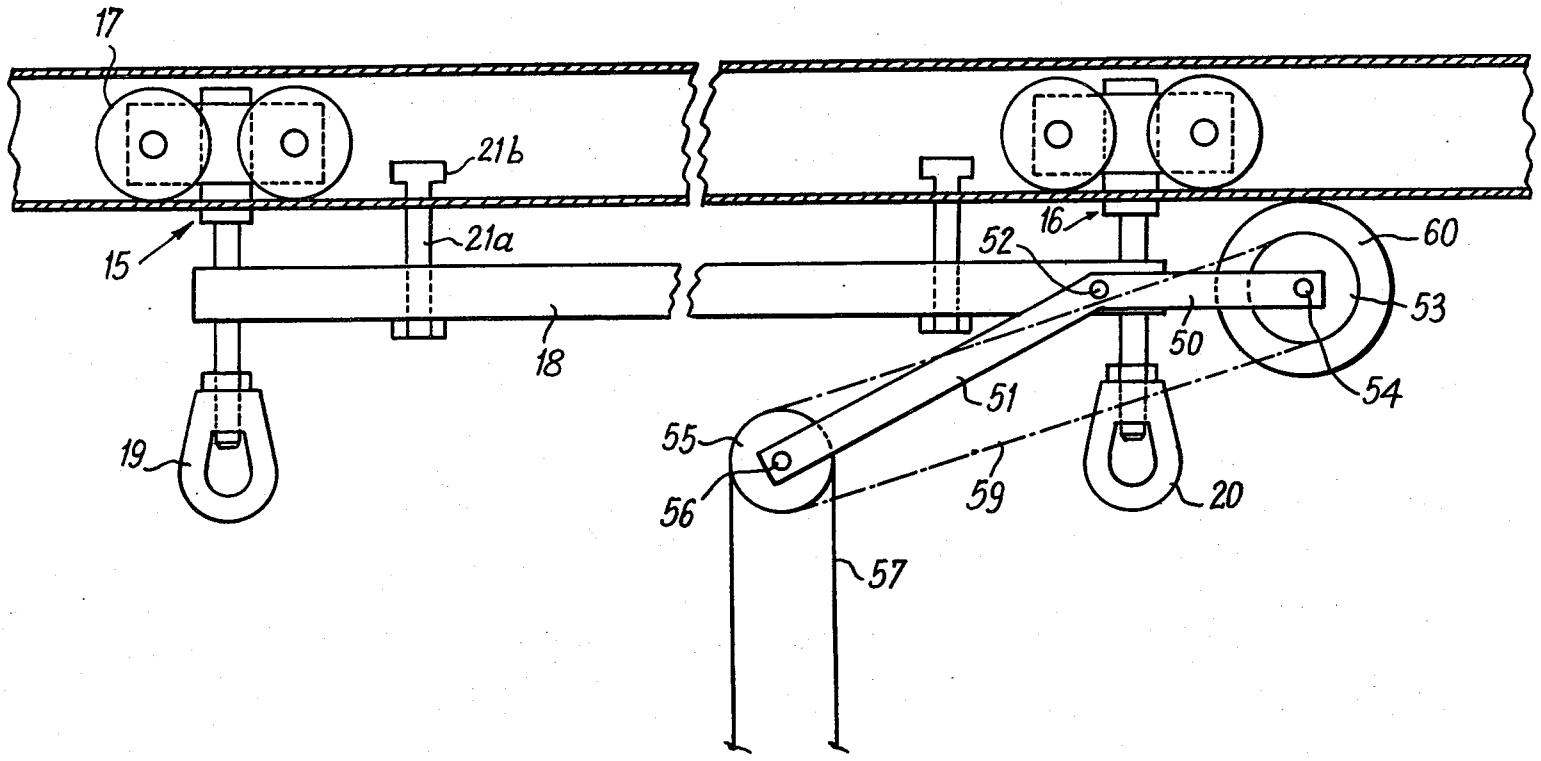
FIG. 7 shows a variation of the embodiment as in FIG. 3.

Referring now to FIG. 7, identical elements are denoted by identical reference numbers. Cross bar 18 has here been simplified, carrying near one end thereof a spindle 52 on which pivots a bracket having a substantially horizontal arm 50 and a downward inclined arm 51, as shown. At the end of horizontal arm 50, a wheel 53 pivots on a spindle 54, while at the end of inclined arm 51, a wheel 55 pivots on a spindle 56. From said wheel 55, an endless rope 57 is freely suspended, said rope extending to the scaffold car.

Wheels 55 and 53 are connected to each other by means of a chain 59. Wheel 53 has an outer lining 60 firmly adhering thereto, said lining consisting of a pneumatic tire, for example.

The length of the inclined arm and the masses constituted by wheel 55 and rope 57 are such that wheel 53 is permanently applied against the lower surface of the rail. Thus, simply by pulling on either end of rope 57, a lateral movement of the scaffold car is made possible.

We claim:

1. A movable scaffold for use on buildings, wherein a scaffold car is suspended from at least two carriages connected to each other by a removable cross bar having a length approximately equal to that of said scaffold car, said carriages being movable along a U-shaped rail formed by sections coupled together and mounted so as to overhang a top of said building by way of support means placed on said building's roof, said scaffold comprising:

a cross bar having a near end connecting said carriages;

a T-shaped safety bracket including a transverse bar, which transverse bar is disposed inside said U-shaped rail perpendicularly to a longitudinal plane of symmetry of said rail, said transverse bar being longer than the spacing of inward bent arms of said U-shaped rail; and wherein each support member comprises:

a soleplate placed against the top of a wall;

two stationary arms in a substantially vertical plane, integral with said soleplate, and converging so as to be able to carry an anchoring head;

two movable arms able to pivot relative to said soleplate and converging so as to be able to carry a hooking member for supporting said scaffold car; and a rod for regulating the position of said movable arms in relation to said stationary arms.

2. A movable scaffold as set forth in claim 1, being further characterized in that the linear components mounted end to end to form the rail (10) are assembled by fitting, in a downward motion, one female end (24) onto one male end (23), said female end having a part (25) designed so as to rest on the upper surface of the male end and be locked thereon.

3. A movable scaffold as set forth in claim 2, being further characterized in that the rail is composed of any desired number of intermediate components (12) each having one male end (23) and one female end (24), one head component (11) closed at one end and having a male end at the other, and one tail end (13) closed at one end and having a female end at the other, each rail component being provided with a means (11*a*, 12*a*) for suspension from the support members, said means being disposed within a short distance from its male end and from its closed end for the end components (11*b*, 13*a*).

4. A movable scaffold as set forth in claim 1, being further characterized in that the movable arms (108, 109) are integral with a shaft (110) pivoting on said soleplate (101).

5. A movable scaffold as set forth in claim 1, being further characterized in that the anchoring head (107) consists of a plate with its edges bent and welded to stationary arms (103, 104), said head carrying an anchoring ring (119) adapted so as to accommodate a cable (121).

6. A movable scaffold as set forth in claim 5, being further characterized in that the anchoring head (107) has a slot (126) into which the end sleeve (127) of said regulating rod (112) is inserted.

7. A movable scaffold as set forth in claim 1, being further characterized in that the regulating rod (112) has a handle (113) at the end thereof, said handle turning into a tube (114) fastened, in the vicinity of the hooking means (111), to a support shaft (117) which is integral with movable arms (108, 109).

8. A movable scaffold as set forth in claims 5 or 7, being further characterized in that a safety chain (120) is mounted between said support shaft (117) and anchoring ring (119).

9. A movable scaffold as set forth in claim 7, being further characterized in that the hooking means (111) consists of a rod bent at its two ends and having a curvature (123) at its center.

10. A movable scaffold as set forth in claims 1 or 3, being further characterized in that it has a bracket with two arms (50, 51), pivoting around a spindle (52) carried by cross bar (18), one arm (50) of the bracket carrying a wheel (53) fitted with a lining (60) firmly adhering thereto so as to apply itself against the bottom of rail (10), the second arm (51) of the bracket carrying a wheel (55) able to be rotated by means of an endless rope (57), the two wheels (53 and 55) integrally rotating by means of a chain (59).

* * * * *